US008414273B2

(12) United States Patent
Williams

(10) Patent No.: US 8,414,273 B2
(45) Date of Patent: Apr. 9, 2013

(54) PULSE PUMP

(76) Inventor: Hansford R. Williams, Bradenton, FL (US)

( * ) Notice: Subject to any disclaimer, the term of this patent is extended or adjusted under 35 U.S.C. 154(b) by 0 days.

(21) Appl. No.: 13/423,241

(22) Filed: Mar. 18, 2012

(65) Prior Publication Data

US 2012/0177512 A1 Jul. 12, 2012

Related U.S. Application Data

(62) Division of application No. 12/805,310, filed on Jul. 23, 2010, now abandoned.

(60) Provisional application No. 61/272,559, filed on Oct. 6, 2009.

(51) Int. Cl.
*F04B 17/00* (2006.01)
*F04B 49/00* (2006.01)

(52) U.S. Cl.
USPC ..... 417/413.1; 417/63

(58) Field of Classification Search ..... 417/36, 417/234, 413.1, 63, 567, 568, 569, 571, 572; 92/99, 100
See application file for complete search history.

(56) References Cited

U.S. PATENT DOCUMENTS

| | | | | |
|---|---|---|---|---|
| 4,004,602 | A | 1/1977 | Cordis et al. | |
| 4,015,912 | A * | 4/1977 | Kofink | 417/417 |
| 4,832,582 | A * | 5/1989 | Buffet | 417/413.1 |
| 4,938,384 | A | 7/1990 | Pilolla et al. | |
| 5,127,625 | A | 7/1992 | Kleinhappl | |
| 5,284,425 | A | 2/1994 | Holtermann et al. | |
| 5,649,647 | A | 7/1997 | Kodarar | |
| 5,669,764 | A | 9/1997 | Behringer et al. | |
| 5,902,096 | A | 5/1999 | Behringer et al. | |
| 6,021,925 | A | 2/2000 | Gashgaee et al. | |
| 6,079,959 | A | 6/2000 | Kingsford et al. | |
| 6,302,660 | B1 * | 10/2001 | Kurita et al. | 417/383 |
| 6,758,657 | B1 | 7/2004 | McNaull et al. | |
| 6,946,844 | B1 | 9/2005 | Colahan et al. | |

(Continued)

FOREIGN PATENT DOCUMENTS

| | | |
|---|---|---|
| FR | 2485108 | 12/1981 |
| WO | WO 88/06404 | 9/1988 |
| WO | WO/99/37577 | 7/1999 |

OTHER PUBLICATIONS

Website, http://news.thomasnet.com/fullstory/17425, "Oscillating Diaphragm Pump is chemically resistant," three sheets originally printed from the internet on May 9, 2008.

*Primary Examiner* — Peter J Bertheaud
(74) *Attorney, Agent, or Firm* — Richard C. Litman

(57) ABSTRACT

The pulse pump is driven by an electric motor and gear reduction driving an eccentric rotor, which, in turn, oscillates a mechanism actuating a diaphragm to transfer fluid through one-way check valves. The pump may be used in a number of different applications, but is particularly useful in applying biodegradation material to consume grease and other biodegradable matter typically found in drainage systems of food processing facilities, converting such matter into carbon dioxide and water. The device includes a system for placing the mechanism in a neutral position when the pump is deactivated, to avoid causing the diaphragm to take a set toward either extreme of travel when parked for an extended time. One embodiment incorporates a multiple piece actuator assembly having a diaphragm sandwiched between components. Another embodiment uses a single piece actuator having a circumferential groove, with the diaphragm having a toxoid configuration and attaching within the groove.

4 Claims, 15 Drawing Sheets

U.S. PATENT DOCUMENTS

| | | | |
|---|---|---|---|
| 7,335,003 | B2 | 2/2008 | Kingsford et al. |
| 2002/0056683 | A1 | 5/2002 | Gibson |
| 2005/0072800 | A1 | 4/2005 | Smith |
| 2006/0021919 | A1 | 2/2006 | Olson et al. |
| 2006/0191824 | A1 | 8/2006 | Arett et al. |
| 2007/0029005 | A1 | 2/2007 | Huang et al. |
| 2007/0041845 | A1 * | 2/2007 | Freudenberger ..... 417/63 |
| 2007/0272710 | A1 | 11/2007 | Bui |

* cited by examiner

PULSE PUMP

CROSS-REFERENCE TO RELATED APPLICATION

This application is a division of U.S. patent application Ser. No. 12/805,310 filed Jul. 23, 2010 now abandoned, which in turn claims the benefit of U.S. Provisional Patent Application Ser. No. 61/272,559, filed Oct. 6, 2009.

BACKGROUND OF THE INVENTION

1. Field of the Invention

The present invention relates generally to fluid transfer pumps. More specifically, the present invention is a reciprocating pulse pump driven by an eccentric rotor and incorporating an electronic system for neutralizing the position of the diaphragm when the pump is inoperative.

2. Description of the Related Art

Relatively small reciprocating pumps incorporating a flexible diaphragm and one-way check valves are used in a number of different fields and environments. In the food processing industry, e.g., restaurants, bakeries, canneries, and the like, processing activities result in the generation of byproducts such as grease, oil, flour, sugar, and other organic matter that tends to adhere to the inner surface of drain lines. As the accumulation increases, so does the potential for drain line blockage and resulting backup.

One of the methods commonly used in such food processing facilities to alleviate the accumulation of organic matter is to use small pumps (generally peristaltic type) as part of an automated delivery system designed to deliver certain biodegradation fluids to a targeted area, which is typically the most active drain leading to the grease interceptor of the facility. The fluids used in these systems (usually water) often include one or more strains of bacteria along with other ingredients such as nutrients, neutralizers, etc., for the purpose of breaking down the grease and other biodegradable byproducts adhering to the inner surfaces of drain lines, into carbon dioxide and water.

Another area of concern is the drink dispenser (often called the "beverage tower") commonly found in various fast food, full service and other restaurants. The drain tube extending from this equipment to the drainage network beneath the floor can become blocked with sugar "snakes," i.e., buildup, in a relatively short period of time and it can be difficult to eliminate such buildup within the relatively small drain tube passages. There are numerous examples of similar situations in which the injection of a biodegradation agent by means of an automated pump would be desirable for controlling and removing the accumulation of biodegradable matter.

A number of pumps have been developed in the past. An example of such is found in French Patent Publication No. 2,485,108 published on Dec. 24, 1981. This reference shows (according to the drawings) a solenoid-actuated diaphragm pump with inlet and outlet one-way check valves.

Thus a pulse pump solving the aforementioned problems is desired.

SUMMARY OF THE INVENTION

The pulse pump comprises various embodiments differing in the configuration of the internal mechanism for operating the pump diaphragm and the diaphragm configuration as well. Each embodiment incorporates an electric drive motor controlled by a power switch (e.g., an "on-off" switch) through a programmable control module. The motor drives a gear reduction system, which in turn drives an output shaft. The shaft rotates an eccentric rotor that in turn oscillates or reciprocates a mechanism, which drives a diaphragm back and forth in a chamber. The chamber communicates with inlet and outlet ports or passages, each having a one-way check valve installed therein. An electronic system for neutralizing the position of the diaphragm during periods of pump inactivity is also provided, to avoid causing the diaphragm to take a "set" toward one extreme of travel or the other.

In one embodiment, the diaphragm is devoid of openings and is sandwiched between components of a multiple piece actuating mechanism. In another embodiment, the diaphragm has a toroid configuration with the inner bead installed within the cooperating groove of a single piece actuating mechanism and with a membrane spanning the inner void, thereby making the diaphragm and actuating mechanism assembly devoid of openings. A variation of this embodiment, used in less demanding applications, omits the membrane spanning the inner void of the diaphragm to provide a true toroid configuration.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a pulse pump for delivering quantities of a fluid from a reservoir to a selected site. The pump is particularly well suited for dispensing a predetermined quantity of a biodegradation agent into the under-floor drain lines and drain tubes of beverage dispensers in restaurants and other locations where such dispensers are typically used, but may be applied to a number of other environments and industries where periodic transfer of a predetermined quantity of fluid is required.

Figure 1:
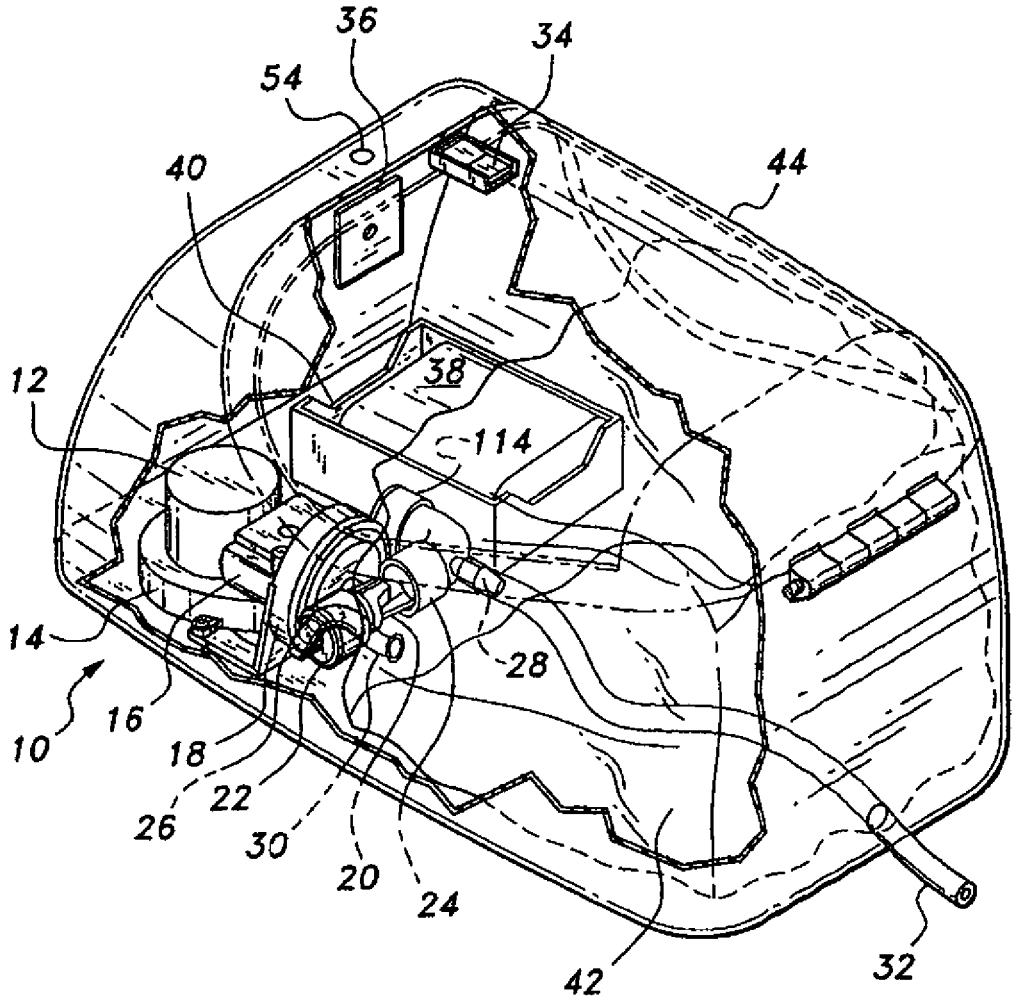
FIG. 1 is a perspective view of a first embodiment of a pulse pump assembly according to the present invention, with the case shown partially broken away.
Figure 2:
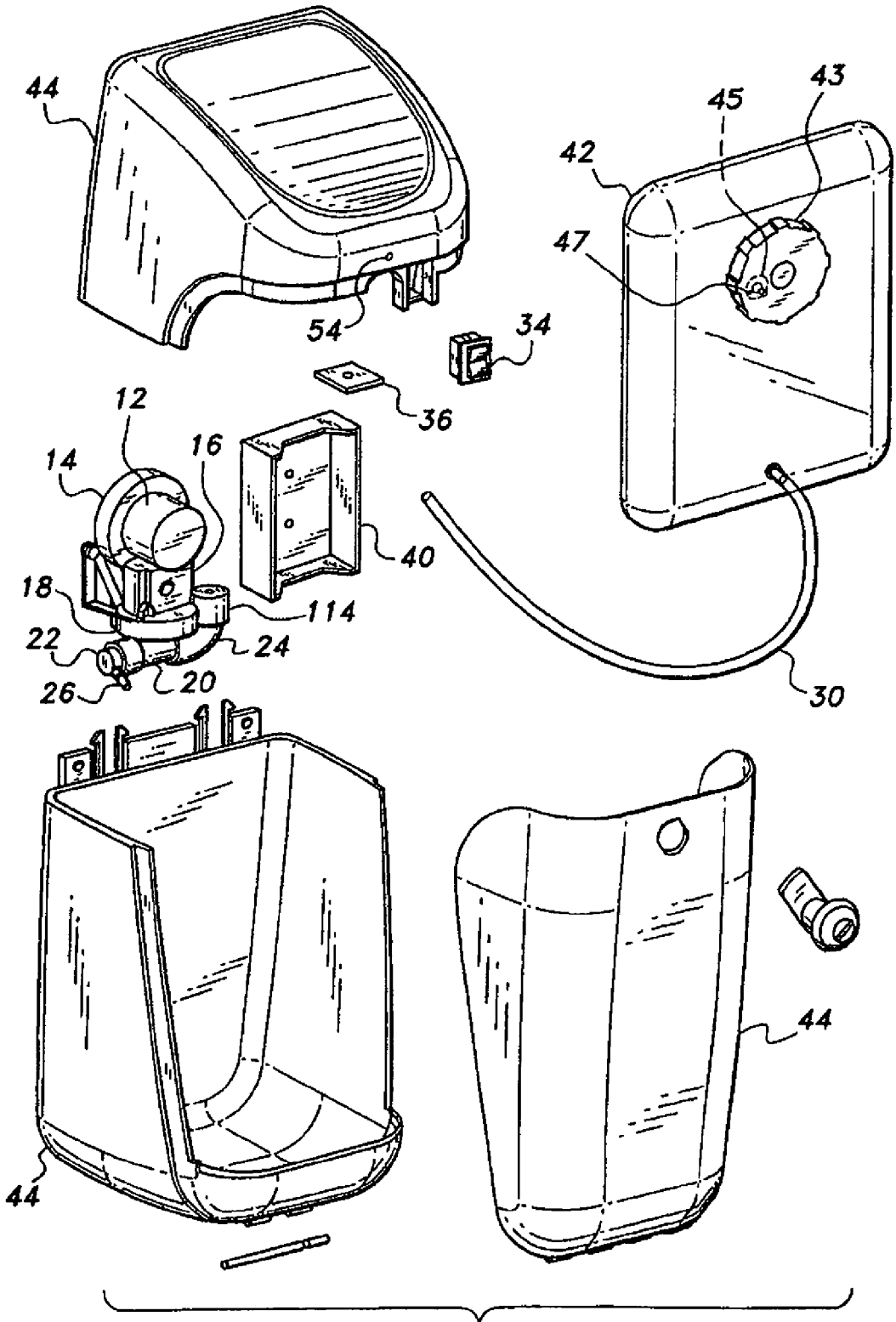
FIG. 2 is an exploded perspective view of the pulse pump assembly of FIG. 1, showing its major components.

FIG. 1 illustrates the pulse pump assembly 10, with FIG. 2 providing an exploded perspective view of the major components of the pump assembly. The pump assembly 10 comprises an electric motor 12, speed reduction gear system 14, reciprocating or oscillating pump actuation mechanism 16, diaphragm assembly 18, pump body 20, inlet check valve 22, outlet check valve 24, an inlet tube connector 26, an outlet tube connector 28, connecting tubes 30 and 32, an electrical power switch (e.g., on-off switch) 34, a control module 36 with an indicator light 54, a reservoir 42, and a battery holder 40 contained within a housing or case 44.

Figure 8A:
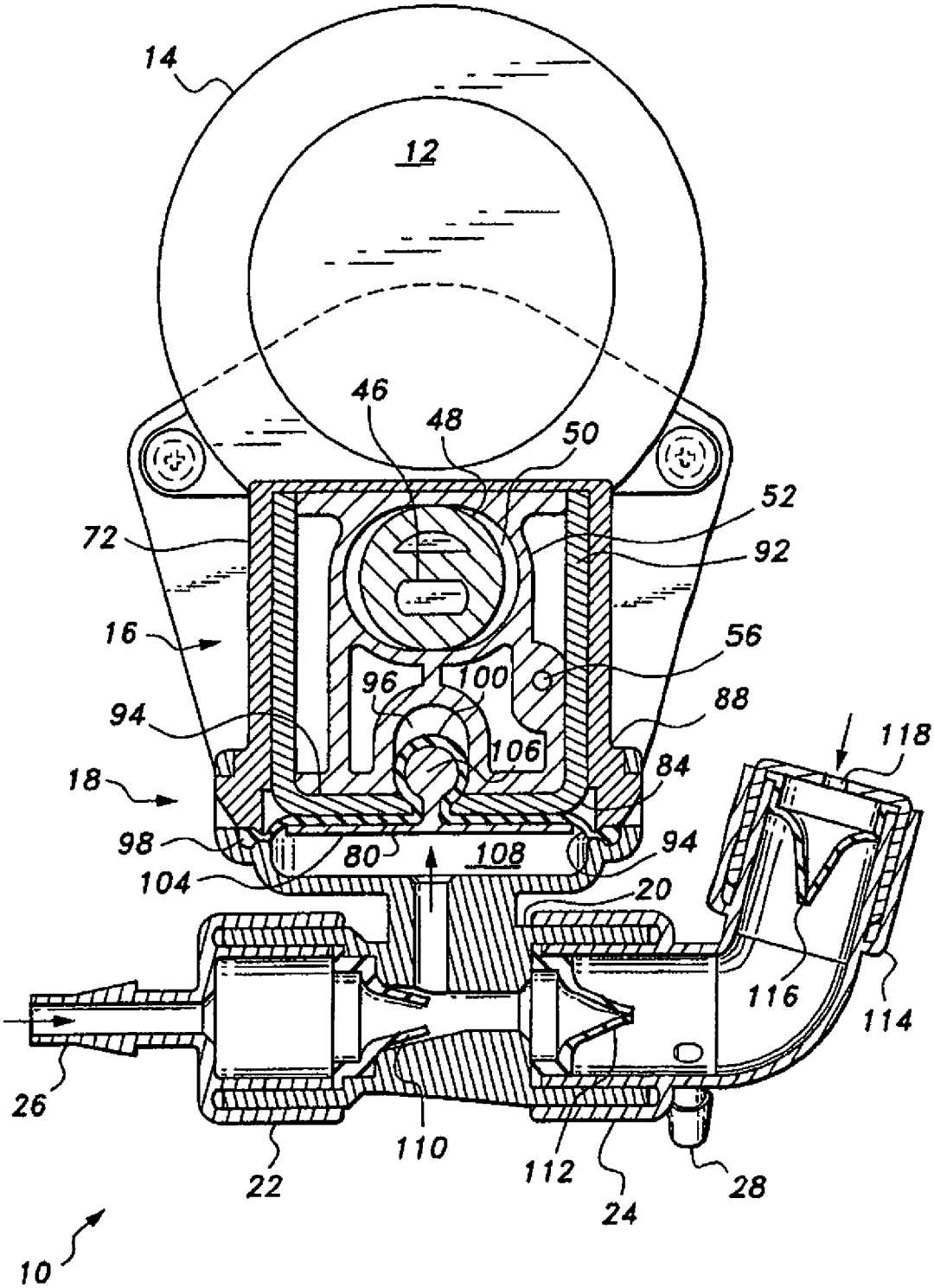
FIG. 8A is a front elevation view in section of the pump and mechanism of FIG. 6, showing the mechanism at one extreme of its travel.

Pump body 20, with inlet check valve 22, outlet check valve 24, inlet tube connector 26 and outlet tube connector 28 attached thereto, may be rotated on the axial centerline of actuator mechanism 16 in 90 degree increments to any orientation needed for a particular application. It will be further noted that by repositioning the locking tabs on the pump body during the molding process, the inlet and outlet check valves 22 and 24 and their appendages can be incrementally positioned to meet the needs of any application. It will also be noted that inlet and outlet tube connectors 26 and 28, which have elbow configurations in the embodiment of FIGS. 1 through 4, can likewise be molded to allow incremental rotational orientation (as shown in FIG. 3) or can be molded with either connector in a straight configuration (as shown in FIG. 8A).

Electrical power for the motor 12 and other functions is provided through power switch 34 and on through a programmable control module 36 by one or more electrical storage cells 38 contained within a battery holder 40 within the housing or case 44. Alternatively, electrical power may be obtained from a conventional electric power grid through a conventional step-down transformer or the like, with a conventional rectifier circuit provided where a d.c. motor is used.

The pulse pump 10 is particularly well suited for the dispensing of a biodegradation agent in various environments, as noted further above. Accordingly, a reservoir 42 (plastic bag, etc.) is installed within the housing or case 44, communicating with the inlet check valve 22 via inlet tube connector 26 and connecting tube 30. The reservoir 42 includes a cap 43 (FIG. 2) having a one-way suction relief valve 45 therein, i.e., a thin rubber disc or "umbrella" valve. This valve 45 is shown in broken lines in the cap 43 in FIG. 2, and allows air to flow into the reservoir 42 through a vent or relief passage 47 in the cap 43 as the biodegradation fluid is drawn from the reservoir. An outlet valve delivery tube 32 or the like (FIG. 1) extends from the outlet check valve 24 and outlet tubing connector 28 to the targeted delivery site of the material being dispensed by the pump 10.

Figure 3:
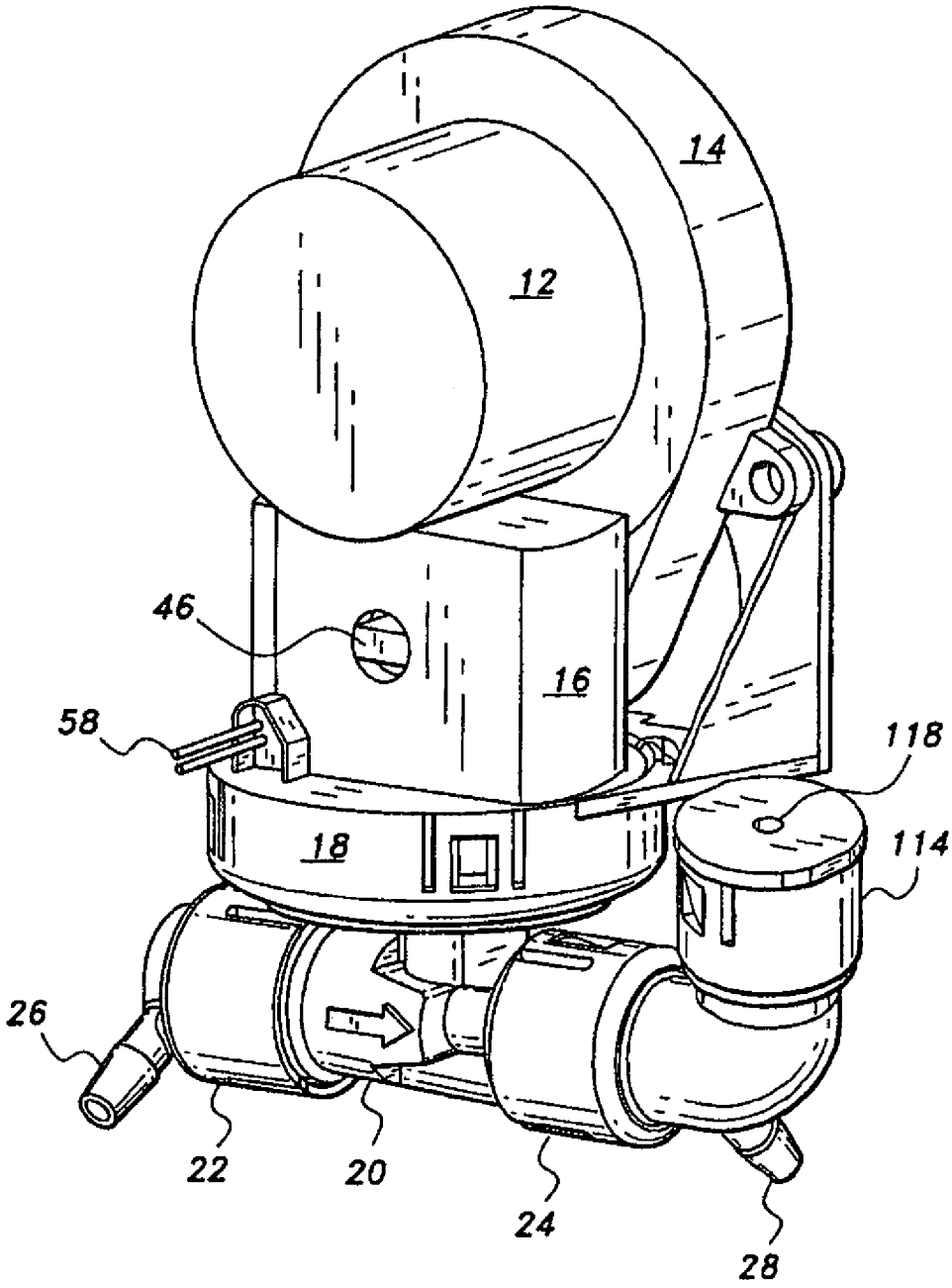
FIG. 3 is a detailed perspective view of the pulse pump of FIG. 1, shown removed from the case.

FIG. 3 of the drawings provides a perspective view of the pump assembly without the peripherals such as the power switch 34, control module 36, electrical storage cells 38, connecting tubes 30 and 32, and dosing material reservoir 42, all of which are essential for the pulse pump to function.

Figure 4:
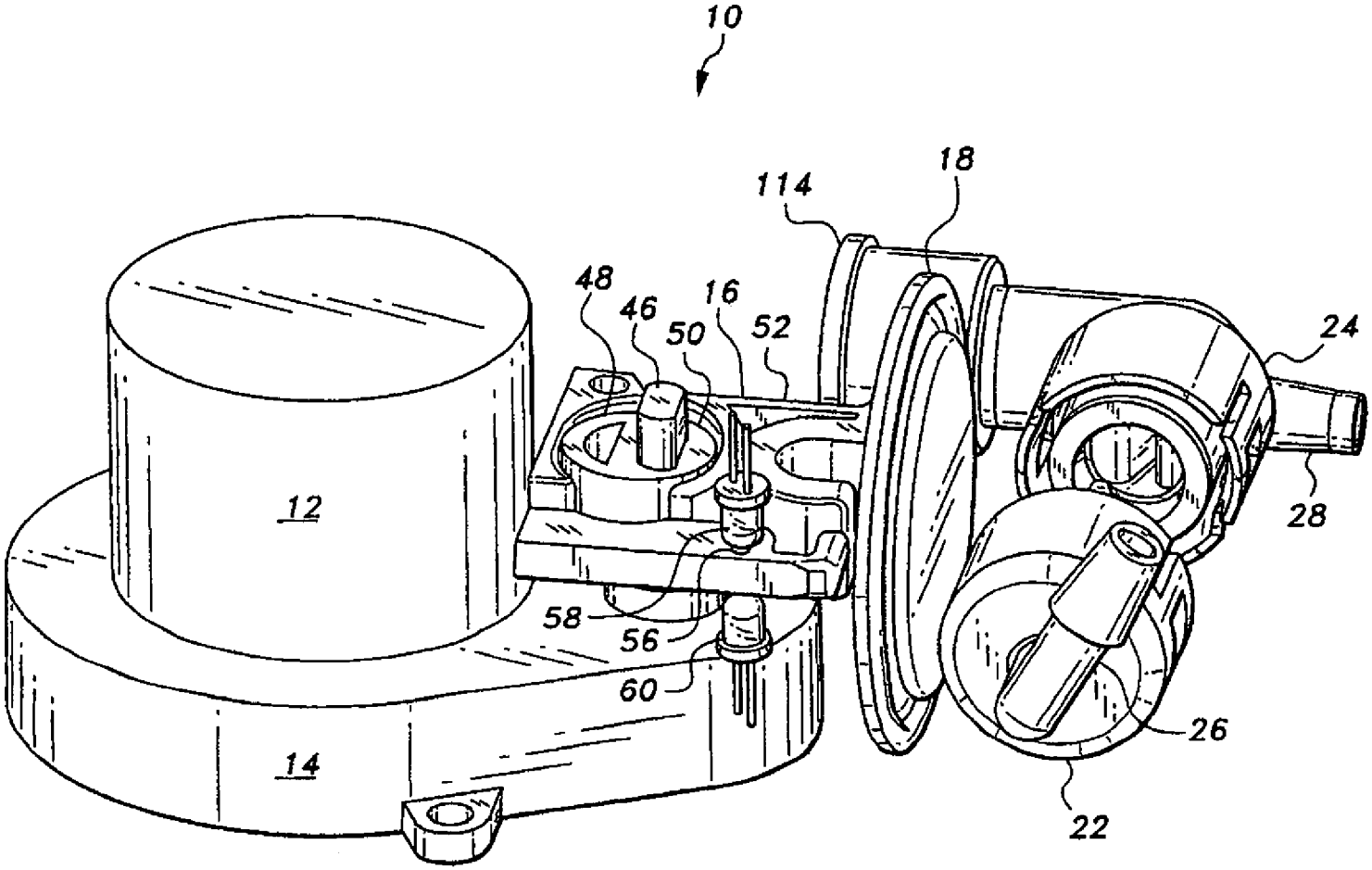
FIG. 4 is a detailed perspective view of the pulse pump of FIGS. 1 through 3, with the pump mechanism housing removed to show the interior mechanism.

FIG. 4 of the drawings provides a view of the pump assembly 10 of the first embodiment with the cover of the actuator mechanism removed, to show more clearly the details of this mechanism. A non-circular output shaft 46 extends from the gear reduction drive 14, and extends into or through an axially offset mating passage in an eccentric rotor 48. As the output shaft 46 rotates, the rotor 48 oscillates eccentrically due to the non-concentric installation of the output shaft 46 therein. The rotor 48 resides within an oval-shaped passage 50 within the reciprocating diaphragm actuator 52, which in turn drives the diaphragm assembly 18 as explained further below. The rotor 48 is free to oscillate laterally within the oval passage 50 of the actuator 52, but the narrower vertical dimension (i.e., normal to the plane of the diaphragm) of the oval passage 50 results in the rotor 48 drawing the reciprocating actuator 52 upwardly and downwardly relative to the plane of the diaphragm (illustrated in other Figs.), thus reciprocating the diaphragm. More specific embodiments of the diaphragm, diaphragm actuator, and other components are shown in FIGS. 6 through 9B, and described in detail further below. Certain components shown in FIG. 4 are common to all of these embodiments, and have common reference numerals where applicable.

FIG. 4 also illustrates another feature of the pulse pump, i.e., means whereby the pump drive is rotated sufficiently to reposition the diaphragm to a neutral or unstressed position during periods of inactivity. This is a useful feature as otherwise the drive system will always stop with the output shaft 46, rotor 48, diaphragm actuator 52, and diaphragm positioned at or near an extreme of their travel. This would likely result in the diaphragm taking a "set" when held in such a distended position for a long period of time between pump actuation, thus affecting the accuracy of the delivery provided by the device 10 and possibly distending the diaphragm to the point that it incurs damage during subsequent operation.

A light passage 56 is formed through the diaphragm actuator 52, with a light source 58 (e.g., LED, etc.) disposed to one side of the actuator 52 and a light receptor 60 (e.g., phototransistor or photocell, etc.) disposed to the opposite side of the actuator. As the diaphragm actuator 52 and diaphragm assembly 18 are reciprocated by rotation of the eccentric rotor 48, the light passage 56 periodically passes between the light source 58 and the opposite detector or receptor 60, with the receptor 60 periodically detecting pulses of light when the light passage 56 is aligned therewith. The control circuit counts the number of times the pulse of light has been detected and when the preprogrammed number of pulses have been detected, the electronic circuit directs the motor drive to remain on to drive the motor through an additional quarter revolution, thereby stopping the motor and pump linkage with the diaphragm in the neutral or unstretched position. The circuit accomplishes this by using a divider system to divide the time between light pulses by four. The control module 36 can also be expanded to receive and process remotely generated signals, e.g., radio frequency (RF) or infrared (IR) signals or signals transmitted by wire from mechanical switches to change the number of preprogrammed pulses between each of a series of motor stoppages, thereby providing the ability to change the number of rotations between motor stoppages without physically accessing or removing the control module 36 for reprogramming the control circuit.

Figure 5:
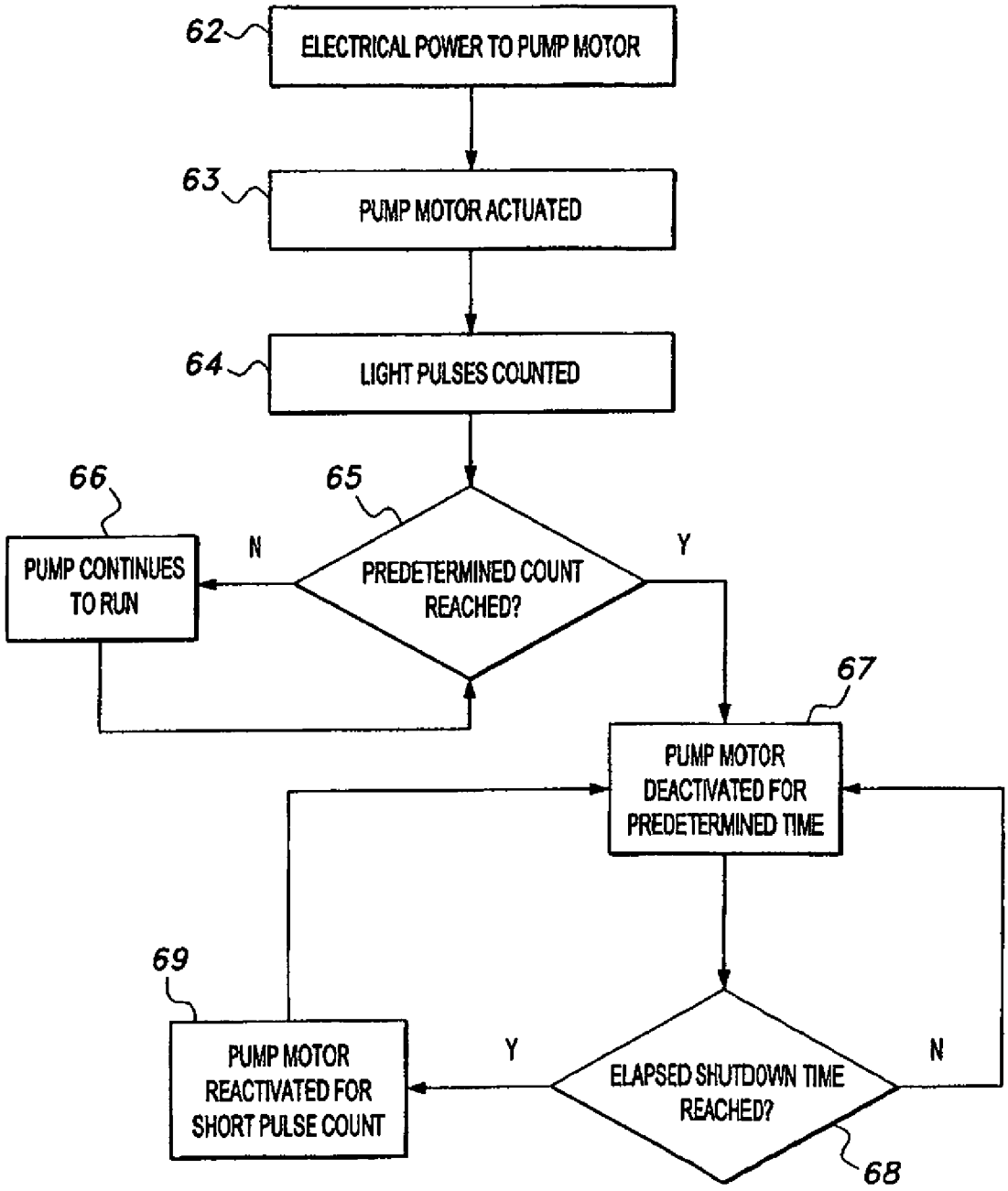
FIG. 5 is a flowchart describing the system operation.

FIG. 5 provides a flowchart illustrating the basic steps in the operation of the diaphragm centering or neutralizing system. Pump assembly components referred to in the discussion of the FIG. 5 flowchart may be seen in various other Figs., particularly FIGS. 1 and 6. Conventional circuitry is used throughout for the following operation. The power switch 34 (FIGS. 1 and 2) is initially actuated to actuate the pump motor 12, as indicated by the first and second steps 62 and 63 in FIG. 5. The indicator light 54 is typically energized at this point to indicate the dispenser is in operation. The indicator light 54, e.g., an LED or other suitable light, may be provided with the capability of emitting green, yellow, or red light to indicate or display various conditions. For example, normal operation may be indicated by a green light, with a flashing red light displayed if operational voltage drops below a certain predetermined value.

The pulse pump is programmed to initially provide a relatively large dose of bioremediation fluid to the system, and then to provide periodic smaller maintenance doses over an extended period of time. When the power switch 34 is actuated (manually or remotely, if so provided), motor operation begins, as indicated by the second step 63 of FIG. 5. This causes liquid to be drawn from the reservoir, through the inlet check valve 22 (FIG. 1, etc.) and into the chamber volume 108 (FIG. 8A) produced by the distension of the diaphragm, with the liquid being forced from the chamber 108 through outlet check valve 24 and on to the targeted treatment area.

As motor operation continues, the control module 36 continually counts the number of light pulses developed by the periodic passage of the light passage 56 in front of the light source 58 (FIG. 4), as indicated by the third step 64 of FIG. 5. So long as the preprogrammed number of light pulses has not been reached, the motor 12 continues to run. This operation continues without interruption, as indicated by the fourth and fifth steps 65 and 66 of the flowchart of FIG. 5. However, when the predetermined number of light pulses has been detected (step 65), e.g., forty pulses or ten revolutions (a larger or smaller number of pulses or revolutions may be programmed as desired or required), the control module 36 shuts off the motor 12, as indicated by the fourth and sixth steps 65 and 67 of FIG. 4.

Simultaneously with motor shutdown, a timer is activated. The timer deactivates the motor 12 for a predetermined period of time, e.g., forty-five minutes (longer or shorter rest times may be programmed, as desired). When the predetermined period of shutdown time has elapsed, as indicated by the seventh step 68 of FIG. 5, the control module 36 will reactivate the pump motor 12 for a short preprogrammed period, or more accurately, a short preprogrammed number of pulse detections, as indicated by the eighth step 69 of FIG. 5. By counting pulses during motor operation rather than operating the motor for a predetermined period of time, the proper number of revolutions (and therefore pump cycles) is assured, which might not be the case if the motor were to operate more slowly due to low voltage or some other reason. This operation continues until electrical power is discontinued to the circuit by shutting off the power switch 34 or otherwise interrupting electrical power to the device.

It will be seen in FIG. 4 that the light passage 56 is located toward one end of the diaphragm actuator 52. Thus, when the light passage 56 is aligned with the light source 58 and receptor 60, the actuator 52 (and diaphragm attached thereto) is positioned toward one extreme of their travel, i.e., toward the motor 12, as shown in FIG. 4. Thus, if the light receptor 60 detects light, the system continues to operate (or reactivates) the motor 12 to drive the gear reduction output shaft 46 another quarter turn, thereby repositioning the diaphragm actuator 52 and diaphragm neutrally between the two extremes of travel.

If no light is detected by the receptor 60 when power to the motor is interrupted, the actuator 52 and diaphragm may be at or toward the other extreme of their operating range. If this occurs, the system continues to operate the motor 12 until the light passage 56 is aligned with the light source 58 and receptor 60. At this point the cycle reverts to that described above, i.e., the system operates the motor 12 to drive the output shaft 46 and rotor 48 another quarter turn to position the actuator 52 and diaphragm neutrally.

Figure 6:
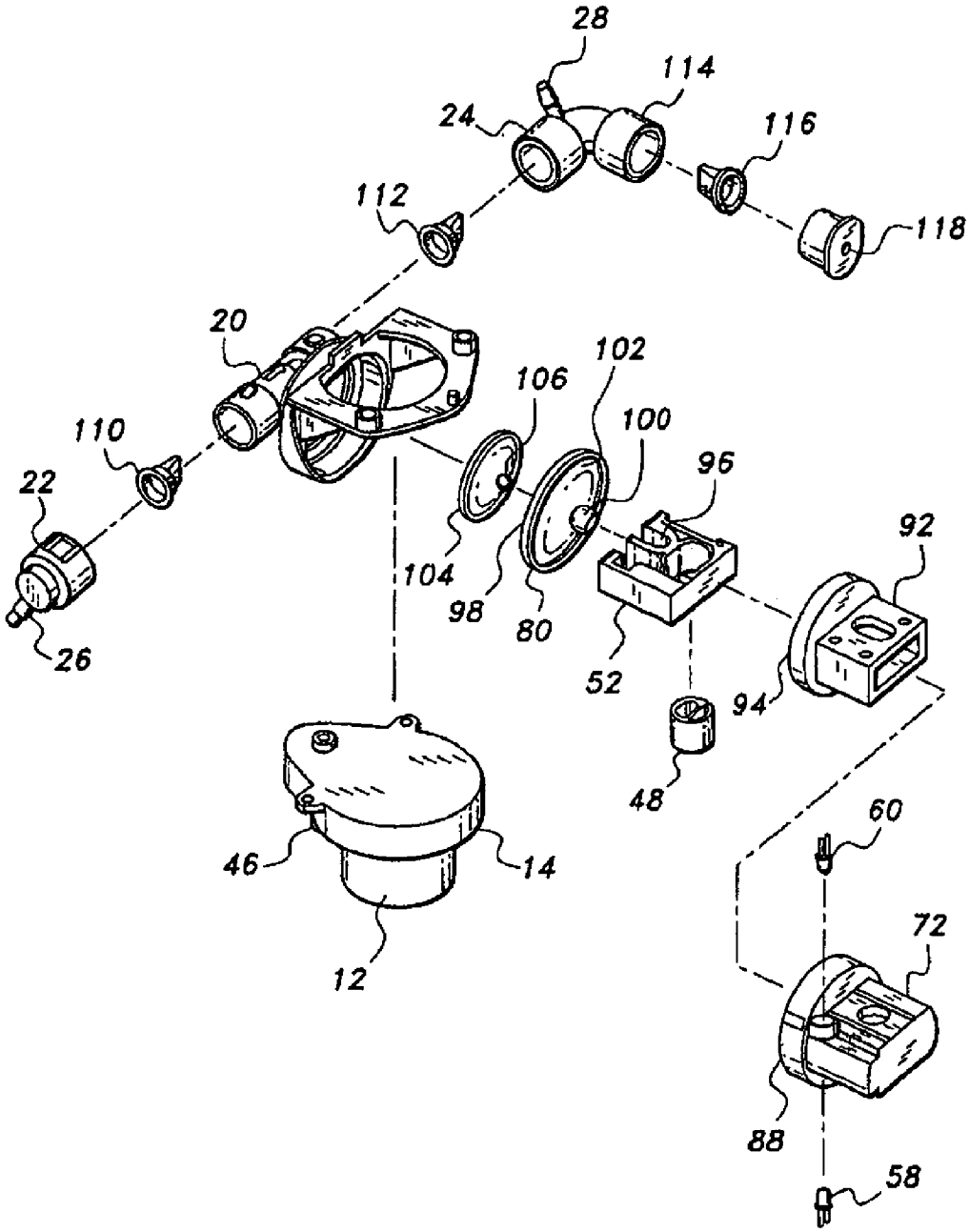
FIG. 6 is an exploded perspective view of the pump mechanism of FIG. 4, showing further details thereof.
Figure 7:
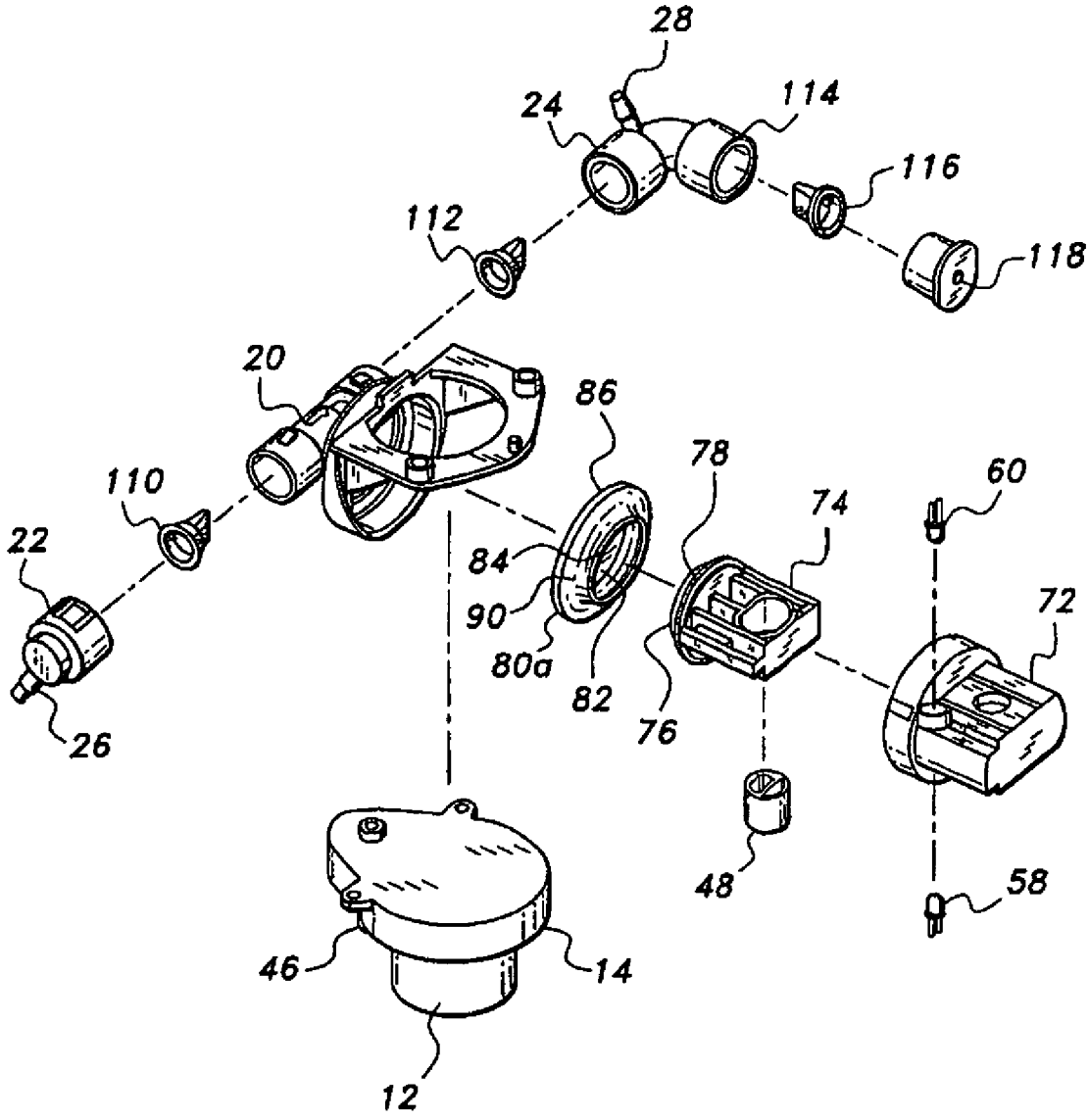
FIG. 7 is an exploded perspective view of an alternative embodiment pump mechanism, showing details thereof.

The pulse pump may include different diaphragm and diaphragm holder or attachment configurations, as desired. FIGS. 6 and 7 provide exploded perspective views of two such configurations. The configuration or embodiment of FIG. 7 may be preferable in some operating environments, as it requires fewer parts and components than the embodiment of FIG. 6.

FIG. 6 provides an exploded perspective view of an embodiment of the diaphragm actuator and diaphragm assembly in which the diaphragm is an unbroken disc devoid of openings or passages therethrough. The mechanism includes a multiple piece actuator housing assembly comprising an actuator housing 72, essentially identical to the housing 72 of the embodiment of FIG. 7, with an actuator sleeve 92 sliding or reciprocating therein. The actuator sleeve 92 includes a circular diaphragm limit flange 94 extending therefrom that limits the upward motion (i.e., toward the output shaft and rotor passing through the actuator) of the central portion of the diaphragm. The diaphragm actuator 52 is immovably affixed within the actuator sleeve 92 to reciprocate with the sleeve 92 in the housing 72, and includes a diaphragm attachment receptacle 96 therein.

The diaphragm 80 of the embodiment of FIG. 6 is a substantially circular unbroken disc devoid of openings therein, as noted further above. The diaphragm 80 includes a peripheral outer bead 98 that seats in and forms a seal with an internal circumferential groove (shown in FIGS. 8A and 8B) within the circular base 88 of the actuator housing 72, with the base 88 also serving as the diaphragm housing as in the embodiment of FIG. 7. The diaphragm 80 of the FIG. 6 embodiment further includes a central hollow bulb 100, with an unbroken and impervious web 102 extending between the central bulb 100 and the outer bead 98.

Figure 8B:
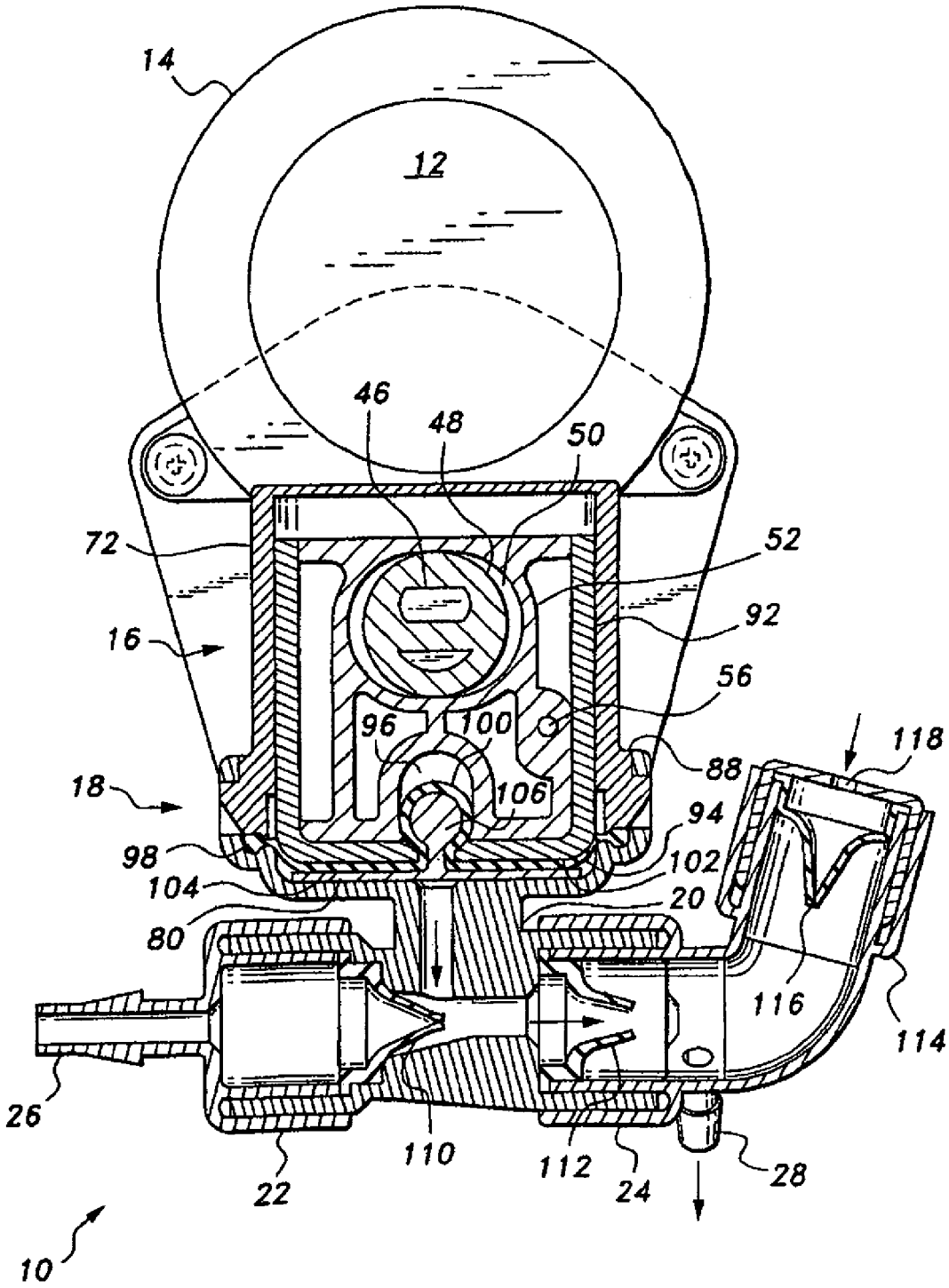
FIG. 8B is a front elevation view in section of the pump and mechanism of FIG. 6, showing the mechanism at the opposite extreme of its travel from that shown in FIG. 8A.

The diaphragm 80 is secured to the actuator 52 by a circular diaphragm limit plate 104 having a diameter slightly less than that of the outer bead 98 of the diaphragm. The limit plate 104 includes a central diaphragm attachment knob 106 extending upwardly therefrom that fits within the hollow bulb 100 of the diaphragm 80, with the bulb 100 and limit plate knob 106 inserted within the diaphragm attachment receptacle 96 of the actuator 52 when the mechanism is assembled as shown in FIGS. 8A and 8B. The limit plate 104, along with the overlying limit flange 94 of the actuator sleeve 92, limits flexure and movement of the diaphragm 80 to the relatively narrow span between the outer edges of the limit flange and limit plate and the captured outer bead 98, to provide consistency in volumetric pumping operations of the device.

FIG. 7 illustrates an alternative embodiment that includes an actuator housing 72, in which the actuator 74 slides or reciprocates back and forth in accordance with the operation described further above for the actuator 52 shown in FIG. 4. The diaphragm actuator 74 of the embodiment of FIG. 7 includes a circular diaphragm attachment flange 76 formed as a unitary component thereof and extending therefrom, with the flange 76 having a diaphragm groove 78 formed peripherally therearound. The diaphragm 80*a* is of either a true toroid configuration with an open center 82, or alternatively a configuration with a membrane 102*a* (FIGS. 9A and 9B) spanning the center, with an inner bead 84 fitting tightly within the diaphragm groove 78 of the actuator 74 and forming a seal therewith. The opposite outer bead 86 of the toroid diaphragm 80*a* seats in and forms a seal with an internal circumferential groove 98 (shown in FIGS. 9A and 9B) within the circular base 88 of the actuator housing 72, with the base 88 also serving as the diaphragm housing. A resilient, flexible, and impervious web 90 extends between the two beads 84 and 86, and serves as a moving seal for the variable internal volume of the pump during operation.

FIGS. 8A and 8B illustrate the two extremes in the position of the bulbed diaphragm 80 in the pump embodiment of FIG. 6. In FIG. 8A, the reduction drive output shaft 46 has rotated the rotor 48 so that its high point is oriented upwardly, thus lifting or moving the diaphragm actuator 52 toward the motor 12. As the actuator 52 is lifted, the actuator sleeve 92, central portion of the diaphragm 80 with its bulb 100, and the diaphragm limit plate 104 with its knob 106 are also lifted with the actuator 52, due to the limit plate knob 106 and diaphragm bulb 100 being captured within the receptacle 96 of the actuator 52. (It will be seen that the side elevation views in section of FIGS. 8A and 8B show the entire width of the actuator sleeve 92, with its flange 94 being equal to this lateral width.)

As the central portion of the diaphragm 80 is raised, a diaphragm chamber volume 108 is developed between the diaphragm 80 (and its lower limit plate 104) and the pump body 20 of the actuator mechanism 16, from which the inlet and outlet valves 22 and 24 depend. As the chamber volume 108 increases with a corresponding drop in pressure, it draws the one-way inlet check valve 110 of the inlet valve assembly 22 open, thus drawing fluid into the diaphragm chamber volume 108. The lesser pressure within the chamber volume 108, and correspondingly greater pressure on the outlet side of the valve assembly, results in the one-way outlet check valve 112 of the outlet valve assembly 24 remaining closed during this portion of the pump operation. While the inlet and outlet check valves 110 and 112 are shown as "duckbill" type valves, it will be seen that any conventional one-way check valve configuration may be substituted for these duckbill valves 110 and 112, e.g., flapper valves, reed valves, and/or poppet valves, all of which are conventional and well known for use as one-way check valves.

In FIG. 8B, the output shaft 46 has rotated 180 degrees from its position in FIG. 8A, thus rotating the eccentric rotor 48 within the oval rotor passage 50 of the diaphragm actuator 52 so the high point of the rotor 48 is oriented downwardly, i.e., toward the diaphragm 80. This pushes the actuator 52, along with its attached actuator sleeve 92, diaphragm 80, and lower diaphragm limit plate 104, downwardly within the actuator housing 72, i.e., toward the check valve assemblies 22 and 24. This reduces or eliminates the chamber volume 108 (shown in FIG. 8A), forcing any fluid contained therein through the outlet check valve 112. The increase in pressure caused by the reduction of the chamber volume results in the inlet check valve 110 being forced closed. However, the orientation of the outlet duckbill (or other one-way valve type, as desired) of the outlet valve 112 causes this valve assembly to open, thus expelling the fluid from the pump and through the outlet tube connector 28 and outlet line, pipe, or tube 32 (FIG. 1). The position of the diaphragm 80 is neutralized at the center of its travel by means of the light sensing and repositioning system shown in FIG. 4 and discussed further above, when the pump is deactivated.

Figure 9A:
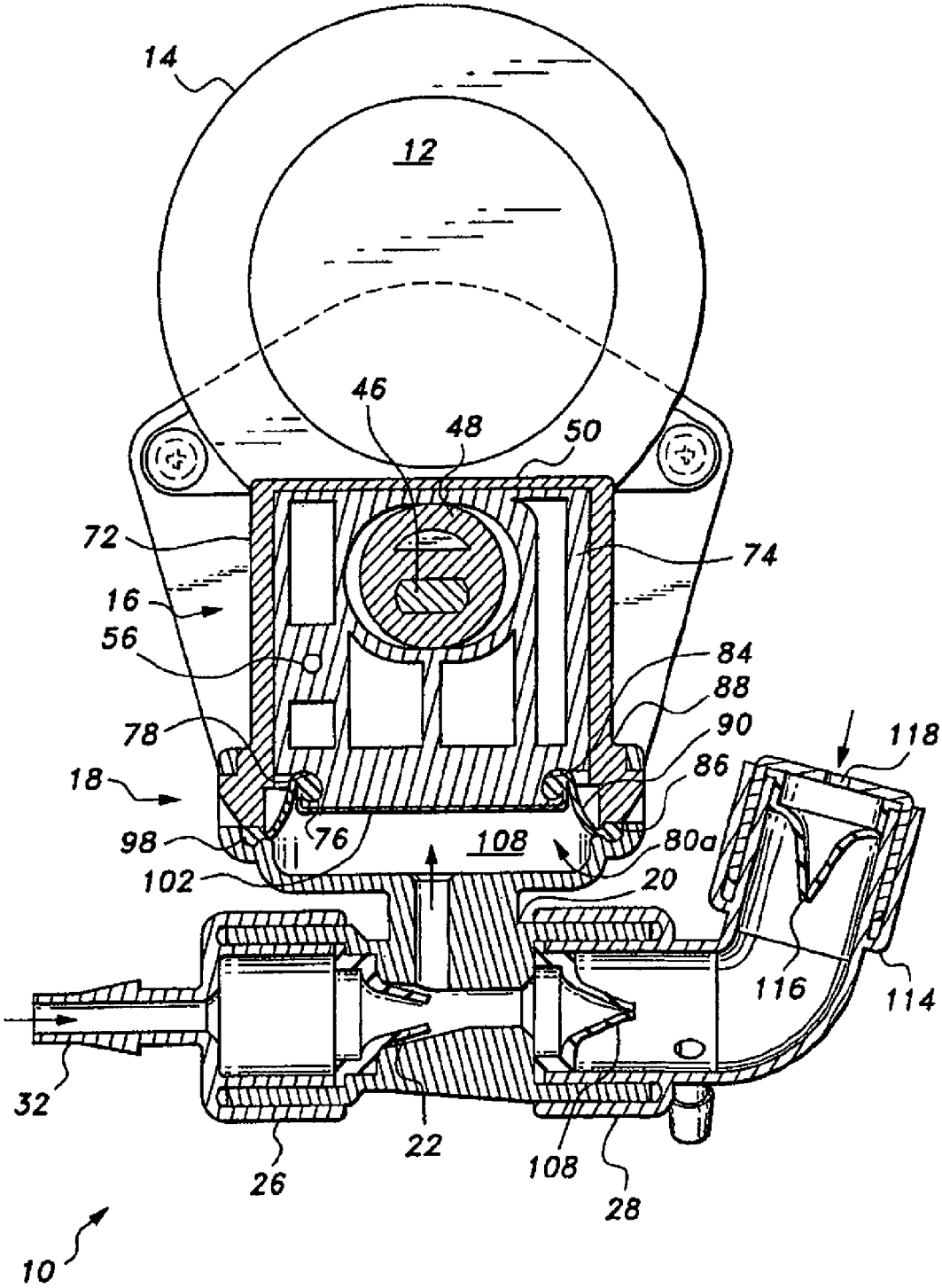
FIG. 9A is a front elevation view in section of the pump and mechanism of FIG. 7, showing the mechanism at one extreme of its travel.
Figure 9B:
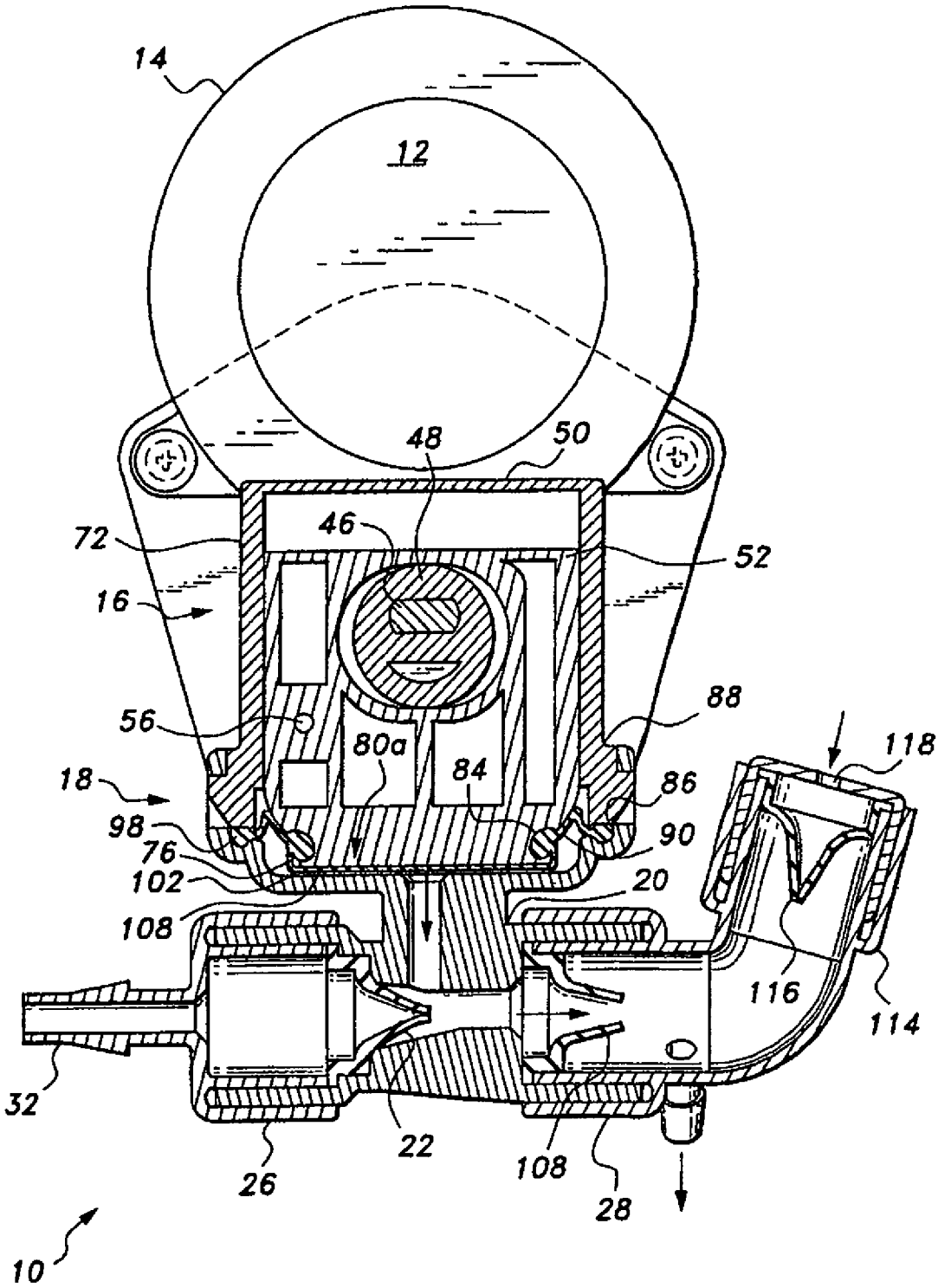
FIG. 9B is a front elevation view in section of the pump and mechanism of FIG. 7, showing the mechanism at the opposite extreme of its travel from that shown in FIG. 9A.
Figure 10:
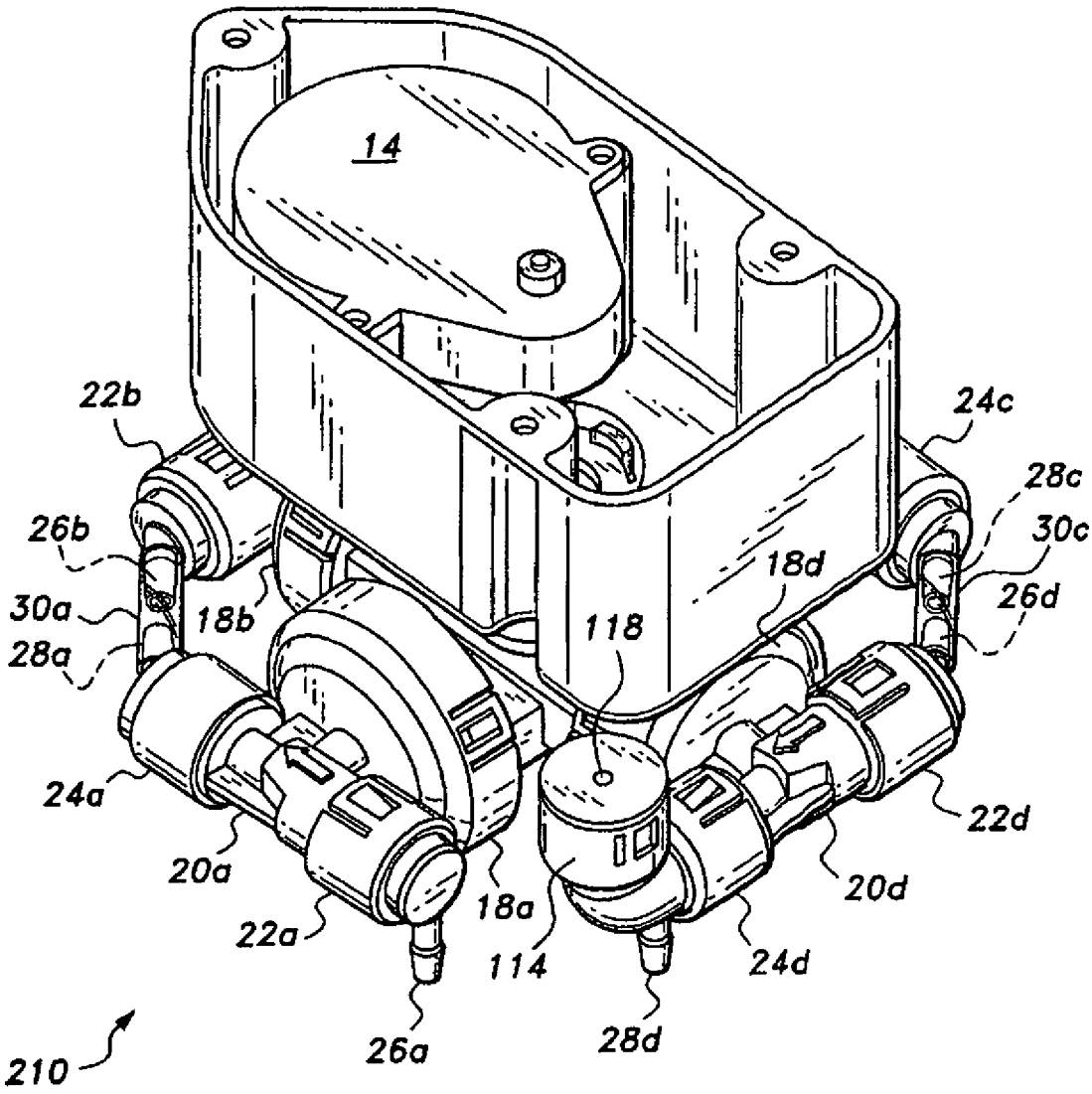
FIG. 10 is a perspective view of another alternative embodiment of the pulse pump mechanism, incorporating multiple diaphragms and corresponding inlet and outlet valves.
Figure 11:
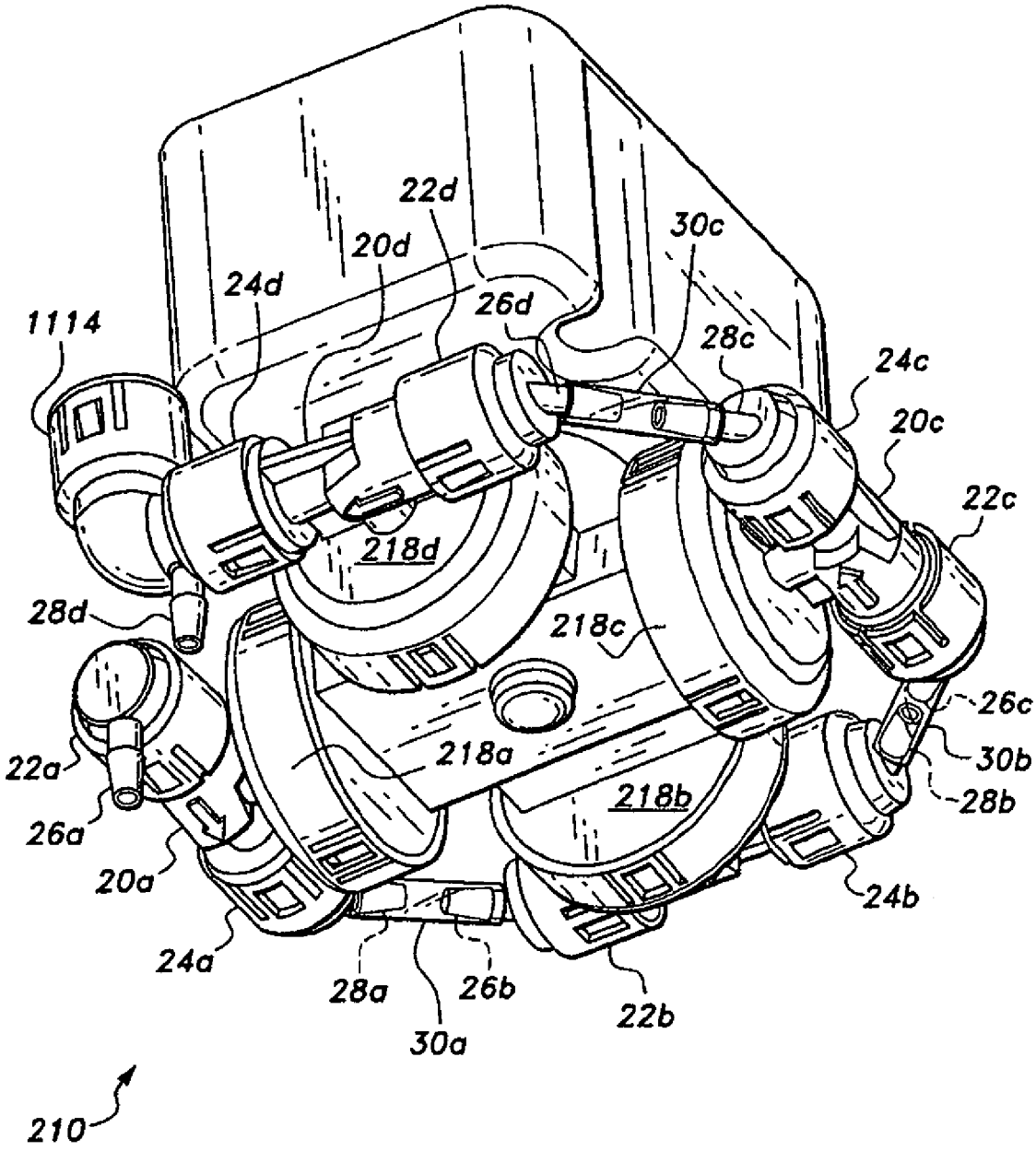
FIG. 11 is a bottom perspective view of the multiple diaphragm and valve pump assembly of FIG. 10, showing further details thereof.
Figure 12:
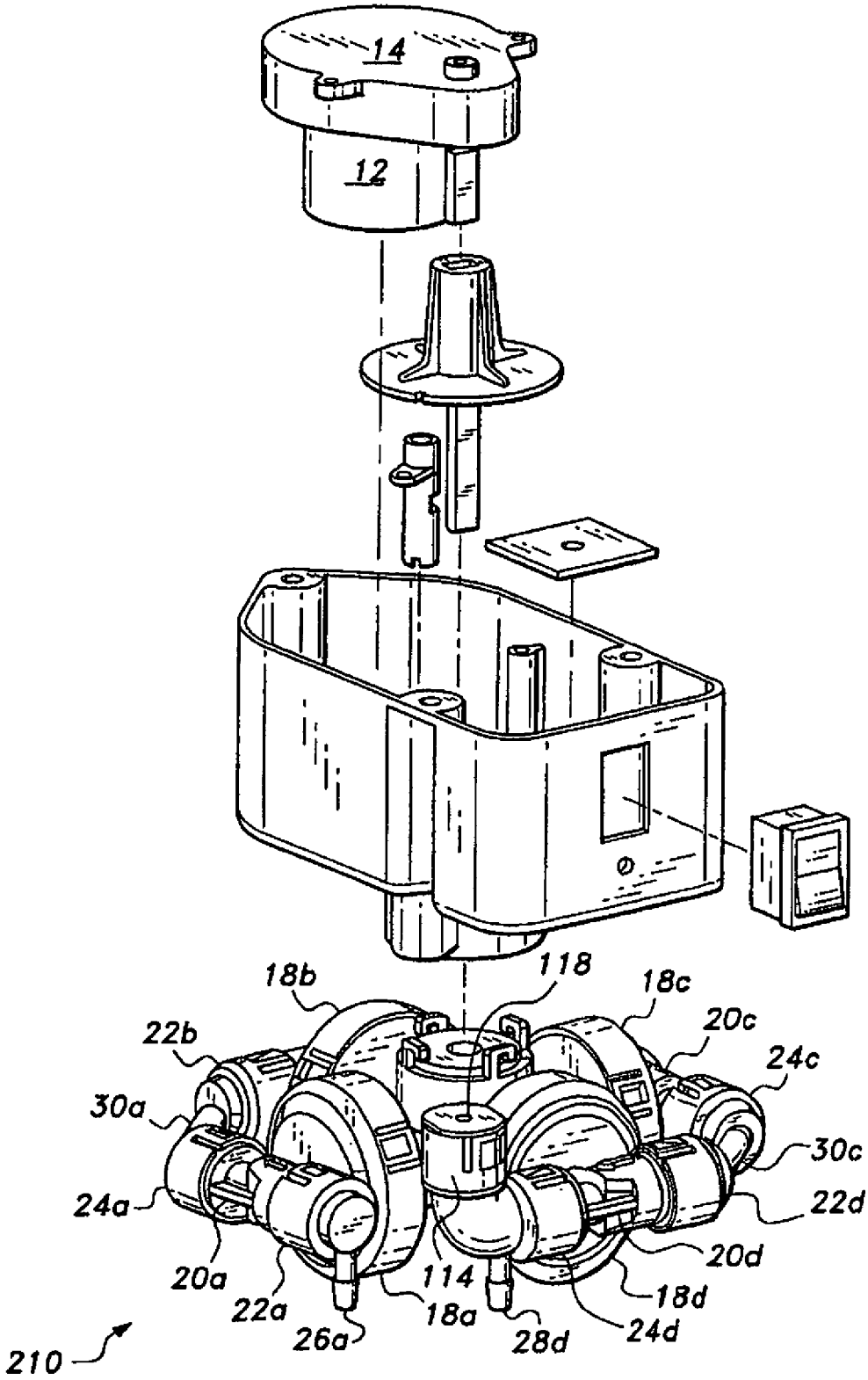
FIG. 12 is an exploded perspective view of the multiple diaphragm and valve pump assembly of FIGS. 10 and 11, showing further details thereof.
Figure 13:
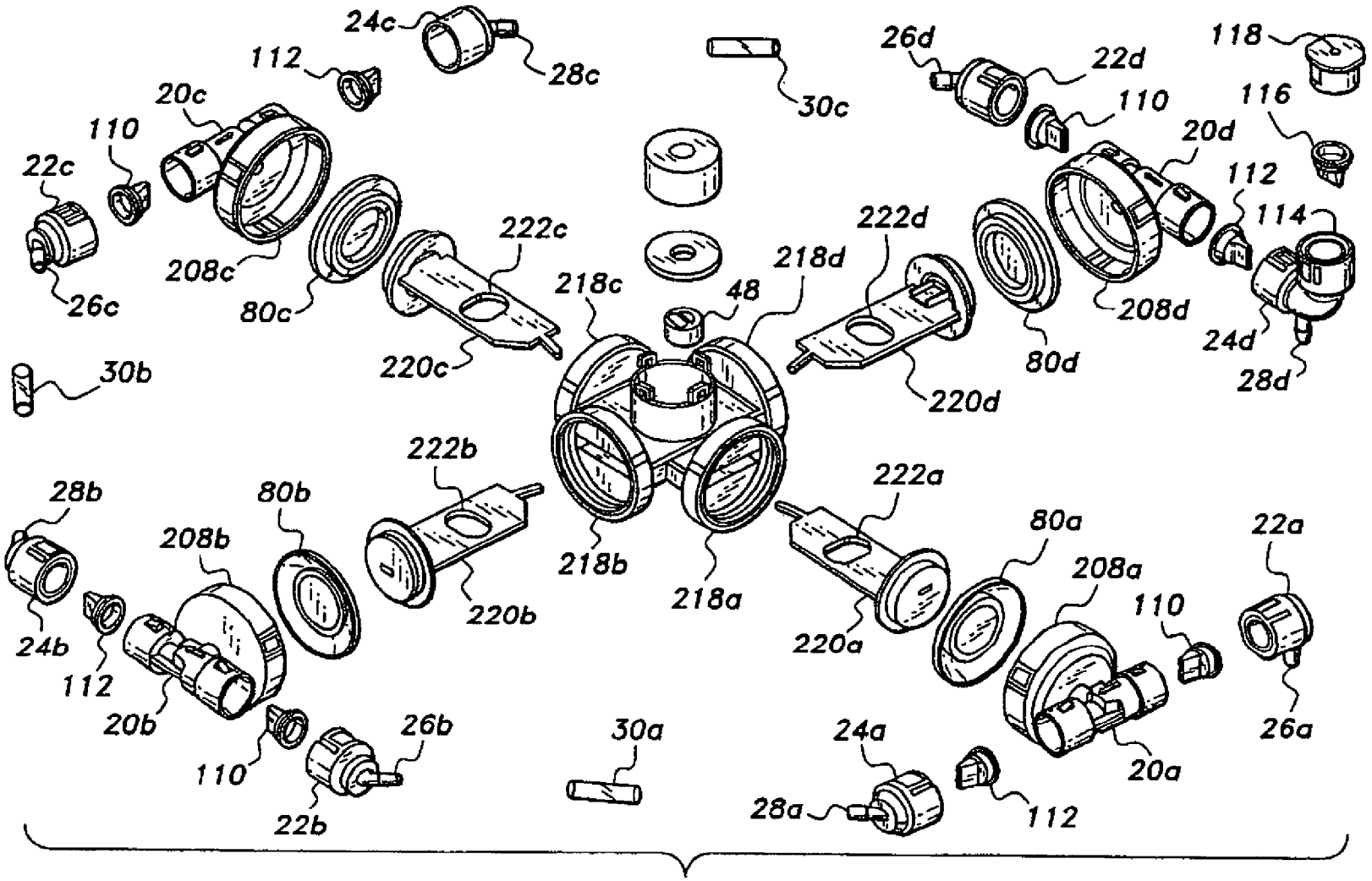
FIG. 13 is an exploded perspective view of the multiple diaphragm and valve pump assembly of FIGS. 10 through 12, showing details of the individual diaphragms, valves, and actuating mechanisms and their relationships.

FIGS. 9A and 9B provide illustrations of the operation of the pulse pump embodiment of FIG. 7, i.e., wherein the diaphragm 80*a* has an inner bead 84 that seats within the diaphragm attachment groove 78 of the diaphragm actuator 74 and an outer bead 86 that seats within the an internal circumferential groove 98 within the circular base 88 of the actuator housing 72. As the two beads 84 and 86 are captured by the structure of the actuator assembly, no central knob or the like is required for the diaphragm 80*a*. Operation of the pulse pump of FIGS. 9A and 9B is essentially the same as that described above in the description of pump operation of FIGS. 8A and 8B, with reciprocation of the rotor 48 and actuator 74 periodically changing the volume of the chamber 108 to pump fluid through the valve body 20.

A couple of different effects have been found in the operation of the pulse pump in its various embodiments, particularly when the outlet line 32 is relatively long. First of all, it has been found that the system will tend to siphon liquid from the supply through the two one-way valves when the power is off, once the system has been primed and the pump body 20 and its two pump assemblies 22 and 24 have been filled. The solution for this problem is the installation of an anti-siphon valve assembly 114 extending from the outlet valve body or assembly 24. A third one-way valve 116, e.g., another duckbill valve or equivalent, is installed within the anti-siphon valve body or assembly 114, oriented in the opposite direction from the outlet valve 112. The anti-siphon valve 116 allows air to flow into the valve body 20 by way of a breather hole or passage 118 in the cap enclosing the anti-siphon valve 116 in the assembly 114. Thus, pressure greater than ambient, as occurs when the system is in operation, closes the anti-siphon valve 116, with the valve 116 preventing the escape of liquid through the breather hole 118. However, when the system is inoperative, any pressure therein less than ambient will cause the anti-siphon valve 116 to open, allowing air to flow into the valve body 20 and break the suction that would otherwise cause liquid to siphon through the system.

The inclusion of such an anti-siphon valve 116 in the system provides another benefit as well. Typically, the pulse pump will be installed several feet above the drain line into which the biodegradation agent is pumped. Each pulse of the pump produces a relatively short stream of agent into the outlet or delivery tube, e.g., two milliliters volume results in a stream of material approaching eight inches long in a tube having a quarter inch internal diameter. However, if the pump is installed with a fall of several feet from pump to delivery tube outlet, it will be seen that the anti-siphon valve 116 will allow nearly all of the delivery tube to fill with air between pulses. This has the beneficial effect of pumping air (and therefore oxygen) into the system with the biodegradation agent, e.g., about a 9 to 1 ratio of air to agent in a typical installation. This ratio will of course vary depending upon the pump stroke volume(s), delivery line diameter, and distance of the delivery line fall to the drain. While the agent is capable of working without the presence of oxygen, it is much more efficient when oxygen is present. Thus, the anti-siphon valve 116 not only eliminates continued siphoning flow of the biodegradation agent through the pump(s) and delivery line when the system has been shut down, but also allows the biodegradation agent to work more efficiently as well by means of the oxygen introduced into the system by means of the anti-siphon valve.

Another effect that has been found is that the withdrawal of liquid from the reservoir results in a partial vacuum being developed within the reservoir 42. This results in the pump motor 12 having to work harder to overcome the vacuum, in addition to pumping the liquid from the reservoir 42 to the outlet line 32. This results in greater energy consumption by the motor 12, thereby depleting the battery or batteries 38 (if used) at a greater rate of discharge. The solution to this problem is the installation of a one-way valve 45 in the cap 43 of the reservoir 42, as shown in FIG. 2 of the drawings. The valve 45 may comprise a thin, flexible sheet of rubber or other suitable material that covers a breather hole or passage 47 in the cap 43, i.e., an "umbrella" type valve or the like. A duckbill valve, as shown in the one-way inlet and outlet valve system, may be incorporated in lieu of such an "umbrella" valve, if desired. When ambient pressure is greater than the pressure within the reservoir 42, the pressure pushes the valve 45 open to allow air to flow into the reservoir 42 to relieve the partial vacuum therein and reduce the load on the pump motor 12.

FIGS. 10 through 13 provide illustrations of yet another embodiment of the pulse pump, in which the pump includes multiple inlet and outlet valve assemblies. This has the benefit of producing greater fluid flow or output per each revolution of the rotor, as well as greatly reducing the pressure fluctuations per revolution produced by a pump having a single inlet and outlet valve assembly.

The multiple valve pulse pump 210 of FIGS. 10 through 13 comprises a central assembly much like that of the pulse pump 10 in its various embodiments, i.e., having an electric motor 12, speed reduction gear system 14, and reciprocating or oscillating pump actuation mechanism as in other embodiments. However, the pump actuation mechanism drives a series of four separate diaphragm assemblies, respectively 218*a* through 218*d*. Each of the diaphragm assemblies is driven by a plate, respectively 220*a* through 220*d* (FIG. 13), with the four plates overlapping one another within the housing. Each plate 220*a* through 220*d* has an oval shaped passage, respectively 222*a* through 222*d*, therethrough, with the eccentric rotor 48 being captured within the plate passages. Thus, as the rotor 48 is rotated by the gear reduction output, it oscillates within the passages 222*a* through 222*d* of the plates 220*a* through 220*d*, thereby causing each of the plates to reciprocate in turn with each succeeding plate trailing 90 degrees behind the previous plate in their cycles.

Each plate 220*a* through 220*d* drives a diaphragm, respectively 80*a* through 80*d* (they may be identical to the diaphragm 80*a* of FIGS. 7, 9A, and 9B). Each of the diaphragms in turn varies the volume of its respective diaphragm chamber 208*a* through 208*d*, essentially as in the pulse pump embodiments described further above. Each of the diaphragm chambers 208*a* through 208*d* has a pump body, respectively 20*a* through 20*d*, extending therefrom. Each pump body in turn includes an inlet valve assembly, respectively 22*a* through 22*d*, and an outlet valve assembly, respectively 24*a* through 24*d*, extending therefrom. Each inlet valve assembly includes a one-way inlet valve 110 installed therein, with each outlet valve assembly having a one-way outlet valve 112 disposed therein.

The first inlet valve assembly 22*a* has an inlet line connector or fitting 26*a* extending therefrom, which would connect to the supply line 30 from the reservoir 42 if the pump assembly 210 were installed in lieu of the pump assembly 10 of FIG. 1. The opposite outlet line connector or fitting 28*a* communicates with the second inlet connector or fitting 26*b* of the second inlet valve assembly 22*b* via an intermediate tube 30*a*. In a like manner, the outlet fitting 28*b* of the second outlet valve assembly 24*b* communicates with the inlet fitting 26*c* of the third inlet valve assembly 22*c* via another intermediate tube 30*b*, with the third outlet fitting 28*c* of the third outlet valve assembly 24*c* communicating with the inlet fitting 26*d* of the fourth inlet valve assembly 22*d*. Finally, the outlet fitting 28*d* of the fourth outlet valve assembly 24*d* connects to an outlet line, e.g., the line 32 of the pump assembly shown in FIG. 1, if the multiple valve pump 210 were used in lieu of the single valve pump shown in FIG. 1. Thus, the valve assembly series 22*a* through 24*d* of the multiple valve pump embodiment 210 operates progressively in sequence as the rotor 48 progressively reciprocates each of the diaphragm drive plates 220*a* through 220*b*, with the output of the first outlet valve assembly 24*a* delivering its fluid to the second inlet valve assembly 22*b*, etc., with fluid passing through each of the inlet and outlet valves in sequence until passing from the system through the fourth outlet valve outlet fitting 28*d*. The result is a much more uniform delivery of fluid, greatly reducing the pressure pulses occurring when a single diaphragm and valve assembly are used.

Otherwise, it will be seen that the multiple diaphragm and valve pulse pump system includes various features found in the various embodiments of the single diaphragm assembly 10 of FIGS. 1 through 9B. For example, the fourth or final outlet valve 24*d* includes an anti-siphon valve assembly 114 extending therefrom, which function is identical to that described further above for the pulse pump embodiment 10. It will also be seen that while a series of four diaphragms 80*a* through 80*d* and corresponding valve bodies 20*a* through 20*d*, inlet valve assemblies 22*a* through 22*d*, and outlet valve assemblies 24*a* through 24*d* with their inlet and outlet valves 110*a* through 112*d* are shown in FIGS. 10 through 13, other arrangements or configurations may be constructed in keeping with the concept described above. For example, two of the four diaphragm actuator plates may be eliminated during assembly, with only two diaphragms and two inlet and outlet valve assemblies remaining operable and interconnected. Alternatively, the central body of the assembly may be reconfigured to provide an odd number of diaphragm assemblies and drives, e.g., three, five, etc., as desired. Moreover, it will be seen that multiple rows of valve assemblies may be stacked relative to one another, with an elongate rotor driving additional rows of diaphragms, depending upon the power output of the drive motor used.

In conclusion, the pulse pump in its various embodiments works well for the delivery of relatively small quantities of precisely metered fluids, e.g., for biodegradation of biodegradable products in the restaurant industry or other environments requiring high levels of sanitation. The different diaphragm and actuator embodiments may be used as desired, with each having certain benefits relative to the other. The pulse pump is preferably configured for essentially automatic operation, with a timer system actuating the pump periodically and for a predetermined amount of time as required. Appropriate annunciator lights may be provided as well to warn of low material supply, low battery power, etc. as desired. Accordingly, the pulse pump in its various embodiments is a most useful accessory in the restaurant and other industries where the precise automated periodic metering or dispensing of a small quantity of fluid is required from time to time.

It is to be understood that the present invention is not limited to the embodiments described above, but encompasses any and all embodiments within the scope of the following claims.

I claim:

1. A pulse pump, comprising:

an electric motor;

an electric power supply electrically communicating with the motor;

a gear reduction drive communicating with the motor;

an output shaft extending from the gear reduction drive;

an actuator mechanism having an eccentric rotor, the output shaft being disposed within the eccentric rotor of the actuator mechanism and selectively actuating the actuator mechanism during motor operation;

at least one diaphragm attached to the actuator mechanism;

a one-way check valve assembly fluidly communicating with the at least one diaphragm;

an anti-siphon valve assembly fluidly communicating with the one-way check valve assembly, the anti-siphon assembly including a one-way valve oriented in the opposite direction from the one-way check valve assembly;

an actuator housing;

the actuator mechanism slidably disposed within the actuator housing;

a substantially circular diaphragm holder depending from the actuator mechanism and formed monolithically therewith;

a diaphragm attachment groove peripherally disposed about the diaphragm holder;

the at least one diaphragm having a toroid configuration and defining an open center, the at least one diaphragm having an inner bead disposed peripherally about the open center and being disposed within the diaphragm attachment groove of the diaphragm holder, an outer bead, and a web between the inner bead and the outer bead, wherein the web forms the toroid configuration of the at least one diaphragm; and wherein the actuator mechanism has a light passage extending therethrough, the pulse pump further comprising;

a light source disposed adjacent the actuator mechanism for periodically passing light through the light passage of the actuator mechanism during operation thereof;

a light receptor disposed adjacent the actuator mechanism and opposite the light source, the receptor periodically receiving light from the light source through the light passage during operation of the actuator mechanism; and means for neutrally positioning the at least one diaphragm and actuator mechanism according to the relative positions of the light passage, light source, and light receptor when operation is terminated.

2. The pulse pump according to claim 1, further comprising:

a biodegradation container fluidly communicating with the one-way check valve assembly; and a case disposed about the electric motor, the electric power supply, the actuator mechanism, the at least one diaphragm, the one-way check valve assembly, and the biodegradation container.

3. The pulse pump according to claim 1, wherein the one-way check valve assembly includes a pair of valves selected from the group consisting of duckbill valves, flapper valves, reed valves, and poppet valves.

4. The pulse pump according to claim 1, wherein the anti-siphon one-way valve is selected from the group consisting of duckbill valves, flapper valves, reed valves, and poppet valves.

* * * * *